US008628221B2

(12) United States Patent
Wang et al.

(10) Patent No.: US 8,628,221 B2
(45) Date of Patent: Jan. 14, 2014

(54) LAMP

(75) Inventors: Che-Wei Wang, Tainan (TW); Ji-Pin Wang, Tainan (TW); Yao-Chien Cheng, Tainan (TW)

(73) Assignee: Chi Lin Technology Co., Ltd, Tainan (TW)

( * ) Notice: Subject to any disclaimer, the term of this patent is extended or adjusted under 35 U.S.C. 154(b) by 364 days.

(21) Appl. No.: 13/017,004

(22) Filed: Jan. 29, 2011

(65) Prior Publication Data

US 2012/0195046 A1 Aug. 2, 2012

(51) Int. Cl.
*F21V 33/00* (2006.01)

(52) U.S. Cl.
USPC ..... 362/311.02; 362/336; 362/337; 362/339

(58) Field of Classification Search
USPC ..... 362/311.02, 331, 336, 337, 339, 340, 362/329, 335, 338, 800
See application file for complete search history.

(56) References Cited

U.S. PATENT DOCUMENTS

| | | | | |
|---|---|---|---|---|
| 1,676,464 | A * | 7/1928 | Ryan | 362/309 |
| 2,536,533 | A * | 1/1951 | Cannon et al. | 362/311.14 |
| 2,887,568 | A * | 5/1959 | Franck | 362/309 |
| 3,448,260 | A * | 6/1969 | Wince et al. | 362/328 |
| 3,705,303 | A * | 12/1972 | Willis et al. | 362/308 |
| 4,870,551 | A * | 9/1989 | Nagel | 362/263 |
| 7,654,713 | B2 * | 2/2010 | Tendo et al. | 362/538 |
| 7,686,486 | B2 | 3/2010 | Tessnow et al. | |
| 8,282,249 | B2 * | 10/2012 | Liang et al. | 362/311.02 |
| 8,427,037 | B2 * | 4/2013 | Liang et al. | 313/113 |

FOREIGN PATENT DOCUMENTS

TW M381724 U1 6/2010

* cited by examiner

*Primary Examiner* — Bao Q Truong
(74) *Attorney, Agent, or Firm* — Cheng-Ju Chiang

(57) ABSTRACT

A lamp comprises a base, at least one light source arranged on the base, a cover positioned on the base and covering the light source, and a structured film arranged adjacent to the light source. The structured film has at least one micro structure configured for guiding part of the light backward emitted from the light source.

11 Claims, 7 Drawing Sheets

LAMP

TECHNICAL FIELD

The present disclosure generally relates to a lamp, and more particularly to an LED (light-emitting diode) lamp.

BACKGROUND

Light-emitting diodes (LEDs) are widely used in various lamps due to the advantages of long lifetime, low power consumption, high luminance, and good environmental protection, etc., and have replaced the conventional light source such as the filament lamp.

Referring to FIG. 1, a typical LED lamp 10 comprises a base 11, at least one LED 12 arranged on the base 11, and an optical protective cover 13 covering the base 11 and the LED 12. The LED 12 is used as the light source to emit light. However, since the LED 12 generally emits the light forwards within a certain angle, the typical LED lamp 10 only emits the light forwards within the certain angle. That is, the typical LED lamp 10 only provides the light within a angle range of 0~90 degrees rather than provides the light within a angle range of 0~180 degrees, wherein the light comes upward and is parallel to a reference surface 14 that is vertical to the base 11, and the angle between the light and the reference surface 14 is 0 degree; and the light comes downward and is parallel to the reference surface 14, the angle between the light and the reference surface 14 is 180 degrees.

However, according to the program requirement for integral LED lamps published by Energy Star, at least 5% of total lumens must be emitted in the 13~180 degrees zone. That is, the lamp needs to emit the light backward, but the typical LED lamp 10 cannot satisfy such requirement.

BRIEF DESCRIPTION OF THE DRAWINGS

The components in the drawing are not necessarily drawn to scale, the emphasis instead being placed upon clearly illustrating the principles of the described embodiments. In the drawings, like reference numerals designate corresponding parts throughout various views, and all the views are schematic.

DETAILED DESCRIPTION OF EMBODIMENTS

Reference will now be made to the drawings to describe exemplary embodiments in detail.

Figure 1:
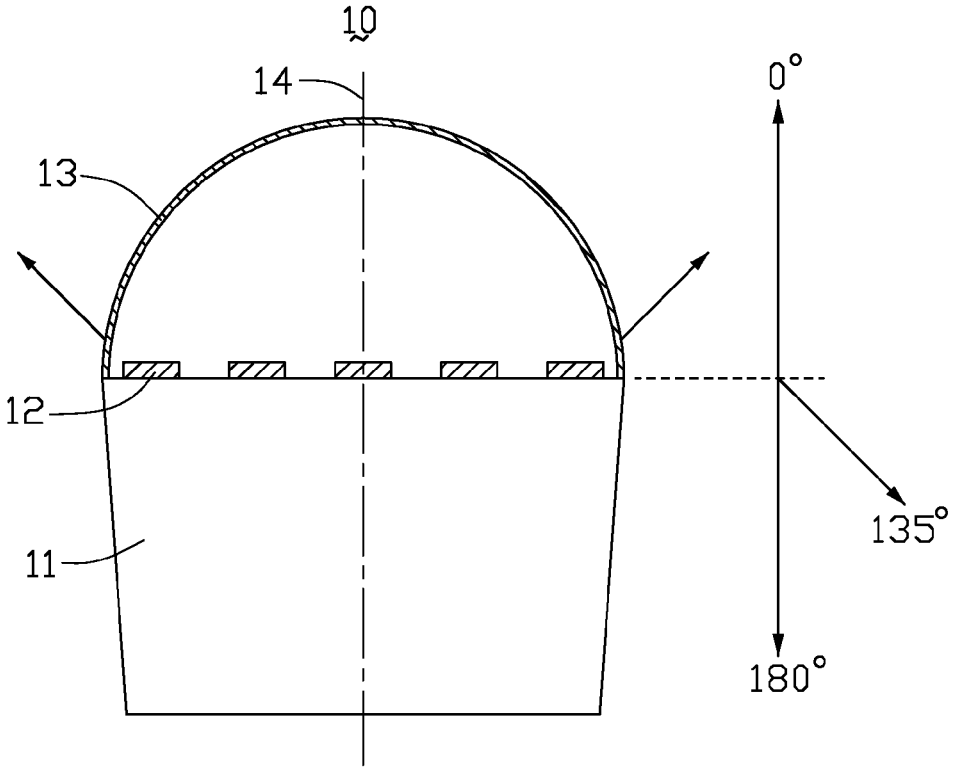
FIG. 1 (PRIOR ART)
FIG. 1 is a cross-sectional view of a typical LED lamp.
Figure 2:
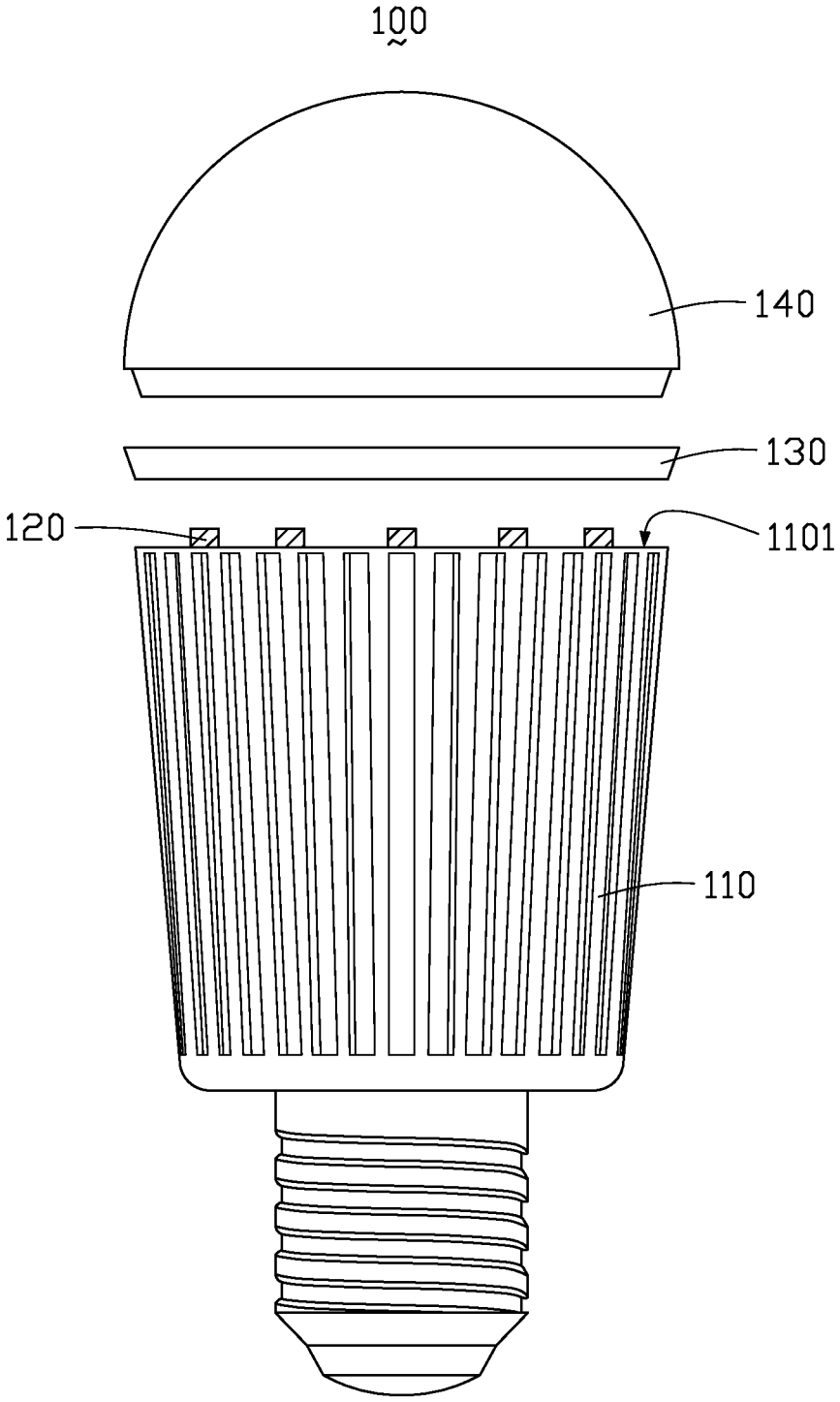
FIG. 2 is a side view of a lamp in accordance with an exemplary embodiment of the present disclosure.
Figure 3:
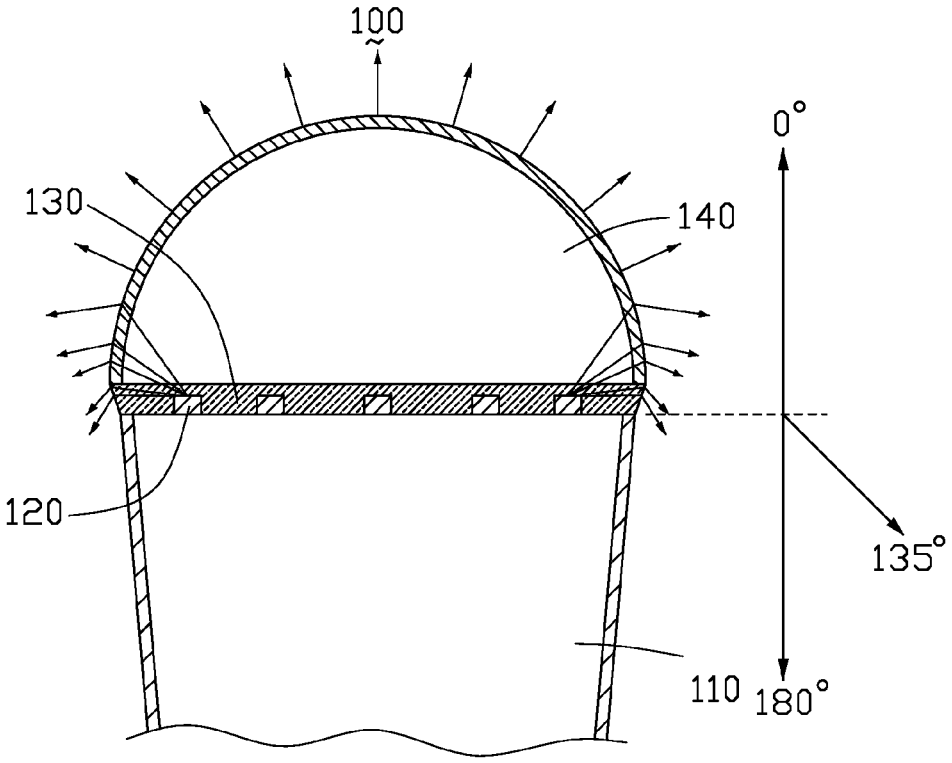
FIG. 3 is a schematic view of light emitted from the lamp as shown in FIG. 2.

FIG. 2 is a side view of a lamp in accordance with an exemplary embodiment of the present disclosure, and FIG. 3 is a partial cross-sectional view of the lamp as shown in FIG. 2. As shown in FIGS. 2 and 3, the lamp 100 may comprise a base 110, at least one light source 120, at least one structured film 130, and a cover 140. The base 110 has a plane 1101. The light source 120 is arranged on the plane 1101 of the base 110, and light is substantially forward emitted and side emitted from the light source 120. The structured film 130 is arranged adjacent to the light source 120 and is wholly(/partially) surrounding the light source 120, and thus the structured film 130 can guide part of the light backward of the lamp 100, wherein the light source 120 may comprise a plurality of LEDs. The cover 140 is used for covering the base 110 and the light source 120.

Figure 4:
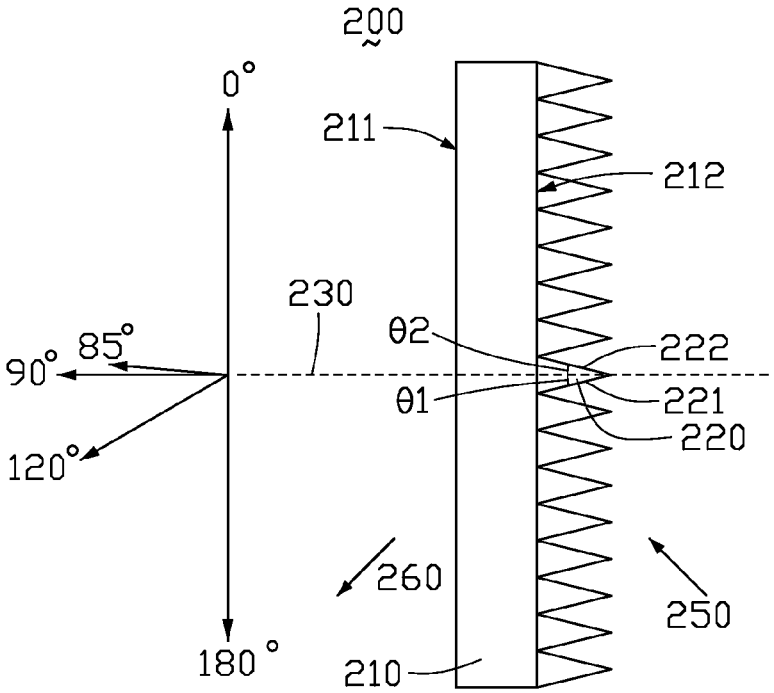
FIG. 4 is a cross-sectional view of the structured film in accordance with an exemplary embodiment of the present disclosure.

FIG. 4 is a cross-sectional view of the structured film in accordance with an exemplary embodiment of the present disclosure. As shown in FIG. 4, the structured film 200 comprises a substrate 210, at least one micro structure 220, a first angle θ1, and a second angle θ2. The substrate 210 may be a transparent optical film, and has a first side 211 and a second side 212 opposite to the first side 211. The micro structure 220 may be arranged on the second side 212 (or on the first side 211) of the substrate 210. The micro structure 220 comprises a first surface 221 and a second surface 222 intersected with the first surface 221, and the first surface 221 is lower than the second surface 222. A reference surface 230 can be defined to be vertical to the second side 212 (or the first side 211) of the substrate 210. That is, when the structured film 200 is arranged upright, the reference surface 230 is a horizontal reference surface. The first angle θ1 is defined between the first surface 221 and the reference surface 230, and a second angle θ2 is defined between the second surface 222 and the reference surface 230.

The substrate 210 and the micro structure 220 may be made of a transparent material, such as polymethyl methacrylate (PMMA), acrylic-based polymer, polycarbonate (PC), polyethylene terephthalate (PET), polystyrene (PS), or copolymer, and an refractive index thereof is between 1.35 and 2.4. It should be understood for a person skilled in the art that, the material of the substrate 210 may be same to that of the micro structure 220. Alternatively, the material of the substrate 210 also may be different from that of the micro structure 220.

One may define as followings: when an incident light comes upward and is parallel to the structured film 200, the angle between the first light and the structured film 200 is 0 degree. When the incident light comes leftward and is vertical to the structured film 200, the angle between the light and the structured film 200 is 90 degrees. When the incident light comes downward and is parallel to the structured film 200, the angle between the light and the structured film 200 is 180 degrees. As shown in FIG. 4, when the incident light 250 reaches the structured film 200 at the angle range of 0~90 degrees, and the structured film 200 can refract the incident light 250 to generate an emitting light 260. The emitting light

260 may emit at the angle of 8~180 degrees. That is, the structured film 200 may refract the incident light 250 forward to emit backward.

Furthermore, one may change the first angle θ1 between the first surface 221 and the reference surface 230 and the second angle θ2 between the second surface 222 and the reference surface 230 to adjust the lumens of the emitting light 260 at a certain angle range according to the actual needs. In this exemplary embodiment, the total lumens of the emitting light 260 passed through the structured film 200 at the angle range of 85~120 degrees is at least 40% of the total lumens thereof at an angle of 0~180 degrees. Of course, one may also adjust the lumens of the emitting light 260 in the angle of 85~120 degrees, so that the lumens of the emitting light 260 in the angle of 85~120 degrees may be larger than 50%, 60% or 70% of the total lumens.

In detail, the first angle θ1 may be between 20 and 28 degrees, and the second angle θ2 may be between 21 and 25 degrees. Preferably, the first angle θ1 is different from the second angle θ2, and the first angle θ1 is 24 degrees and the second angle θ2 is 23 degrees. As tested by the applicant, the lumens of the emitting light 260 in the angle of 85~120 are about 95.21% of the total lumens. Alternatively, the first angle θ1 may be between 35 and 45 degrees, and the second angle θ2 may be between 17 and 23 degrees. Preferably, the first angle θ1 is 40 degrees and the second angle θ2 is 20 degrees. As tested by the applicant, the lumens of the emitting light 260 in the angle of 85~120 degrees is about 78.76% of the total lumens. Alternatively, the first angle θ1 may be between 27 and 33 degrees, and the second angle θ2 may be between 3 and 5 degrees, wherein the micro structure 220 is arranged on the first side 211 of the substrate 210. Preferably, the first angle θ1 is 30 degrees, and the second angle θ2 is 4 degrees. As tested by the applicant, the lumens of the emitting light 260 in the angle of 85~120 degrees is about 75.91% of the total lumens. Alternatively, the first angle θ1 may be between 16 and 22 degrees, and the second angle θ2 may be between 8 and 17 degrees. Consequently, the lumens of the emitting light 260 in the angle of 85~120 degrees is larger than 40% of the total lumens.

Figure 5:
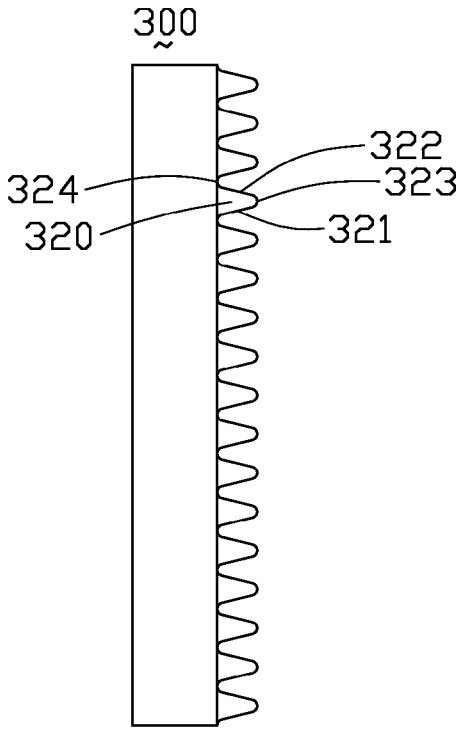
FIG. 5 is a cross-sectional view of the structured film in accordance with another exemplary embodiment of the present disclosure.

FIG. 5 is a cross-sectional view of the structured film in accordance with another exemplary embodiment of the present disclosure. As shown in FIG. 5, the structured film 300 of this exemplary embodiment is similar with the structured film 200 as shown in FIG. 4, except that the micro structure 320 of the structured film 300 further comprises a first curved chamfer surface 323 between the first surface 321 and the second surface 322, and the first curved chamfer surface 323 is linked with the first surface 321 and the second surface 322. In addition, a second curved chamfer surface 324 is between two micro structures 320.

Figure 6:
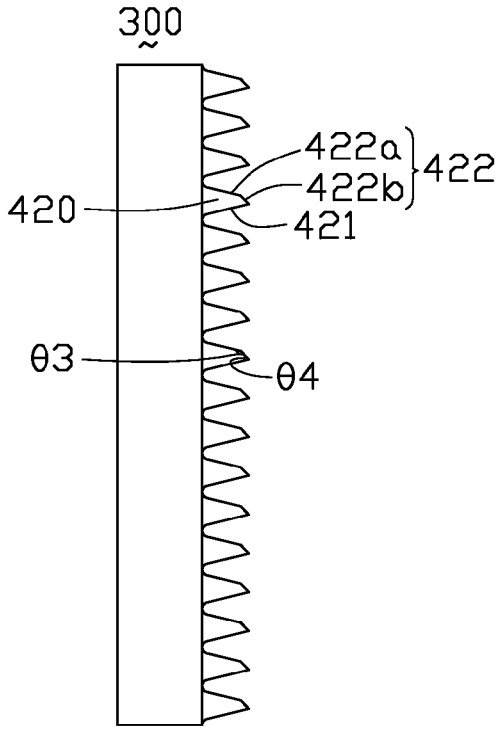
FIG. 6 is a cross-sectional view of the structured film in accordance with another exemplary embodiment of the present disclosure.

FIG. 6 is a cross-sectional view of the structured film in accordance with another exemplary embodiment of the present disclosure. As shown in FIG. 6, the structured film 400 of this exemplary embodiment is similar with the structured film 200 as shown in FIG. 4, except that the micro structure 420 of the structured film 400 comprise a first surface 421 and a second surface 422, and the second surface 422 further comprises a first sub-surface 422*a* and a second sub-surface 422*b*. The first sub-surface 422*a* is intersected with the second sub-surface 422*b*, and the second sub-surface 422*b* is between first sub-surface 422*a* and the first surface 422. A third angle θ3 is defined between the first sub-surface 422*a* and the second sub-surface 422*b*, and the third angle θ3 may be between 140 and 150 degrees. A fourth angle θ4 is defined between the second sub-surface 422*b* and the first surface 421, and the fourth angel θ4 may be between 60 and 70 degrees. Of course, it should be understood for a person skilled in the art that, the first surface 421 may be consisted of two or more sub-surfaces. Furthermore, a curved chamfer surface may be arranged between the two adjacent surfaces, ex, first sub-surface 422*a* and the second sub-surface 422*b*, the second sub-surface 422*b* and the first surface 421, or two contiguous surfaces of two adjacent micro structures.

Referring to FIGS. 2 and 3 again, the structured film 130 is a ring shape, and surrounds the LEDs 120, thus the forward light emitted from light source 120 may reach the structured film 130 and is refracted to emit backwards. Therefore, the lamp 100 can emit the light at a angle range of 0~180 degrees, and the lamp 100 can satisfy the program requirement for integral LED lamps published by Energy Star which at least 5% of total lumens must be emitted in the 135~180 degrees zone.

In this exemplary embodiment, the structured film 130 is positioned on the cover 140. In detail, the structured film 130 may be fixed or adhered out of grooves of the cover 140.

Figure 7:
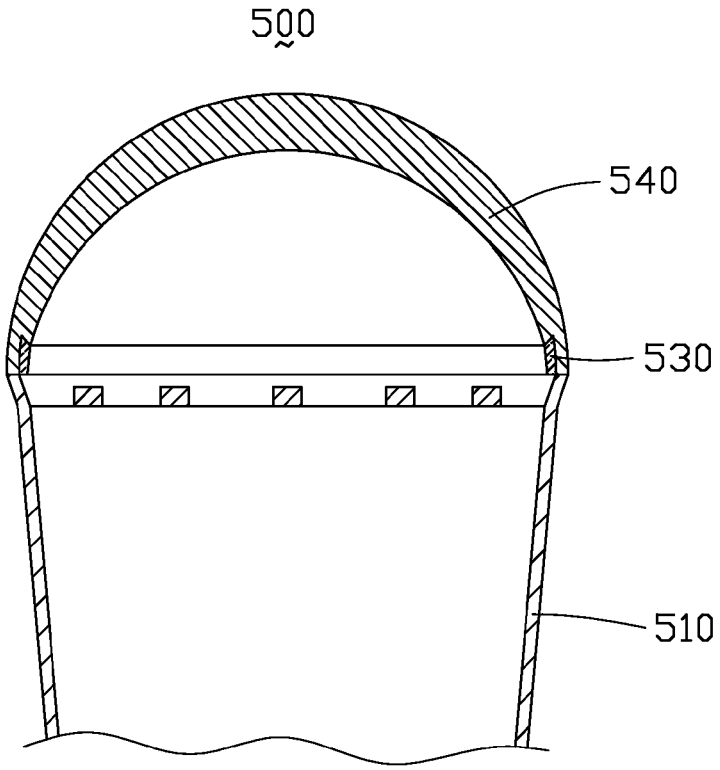
FIG. 7 is a cross-sectional view of a lamp in accordance with another exemplary embodiment of the present disclosure.

FIG. 7 is a cross-sectional view of a lamp in accordance with another exemplary embodiment of the present disclosure. As shown in FIG. 7, the lamp 500 of this exemplary embodiment is similar with the lamp as shown in FIGS. 2 and 3, except that the structured film 530 is positioned within the cover 540, and it may be fixed or adhere in(/out) the grooves of the cover 540. Of course, it should be understood for a person skilled in the art, the structured film also may be together integrated with the bottom part of the cover together which is adhered to or adjacent to the base 510.

Figure 8:
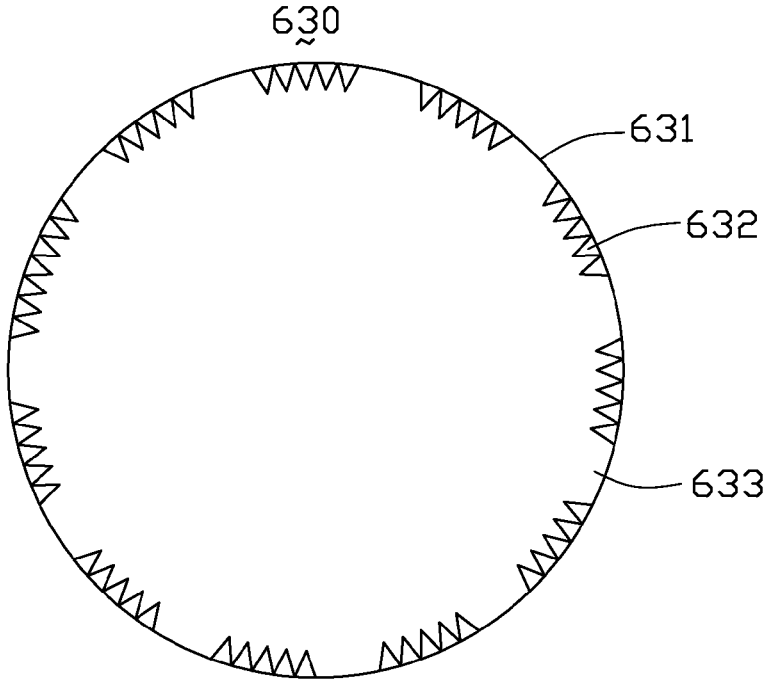
FIG. 8 is a schematic view of the structured film in accordance with another exemplary embodiment of the present disclosure.

FIG. 8 is a schematic view of the structured film in accordance with another exemplary embodiment of the present disclosure. Referring to FIG. 8, the structured film 630 may comprises a base 631 and a plurality of micro structures 632. The micro structures 632 are discontinuously positioned on the base 631, and a plane area 633 may form between the two adjacent micro structures 632. The plane area 633 may be transparent. Of course, alternatively, the plane area 633 also may be non-transparent.

Figure 9:
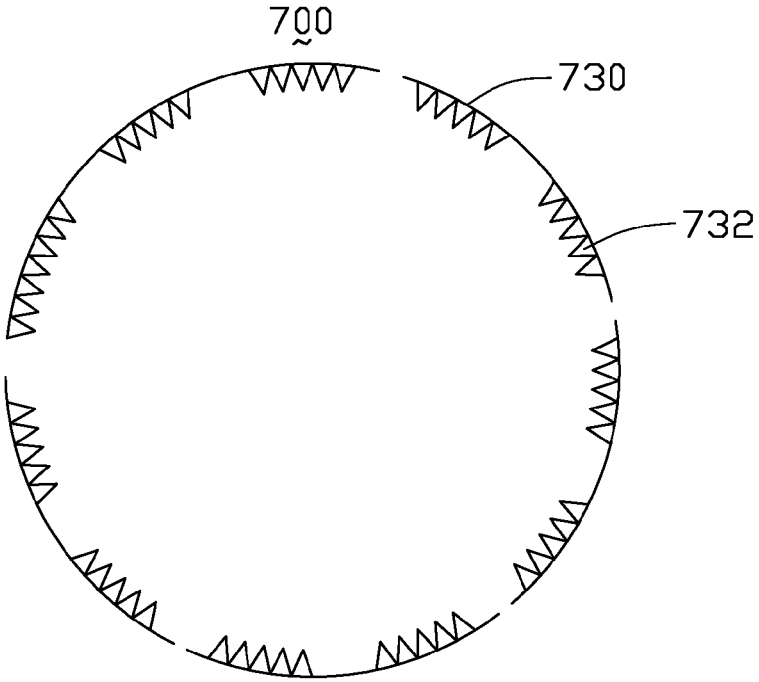
FIG. 9 is a schematic view of a plurality of structured films included in the lamp in accordance with an exemplary embodiment of the present disclosure.

FIG. 9 is a schematic view of a plurality of structured films included in the lamp in accordance with an exemplary embodiment of the present disclosure. Referring to FIG. 9, the lamp 700 comprises a plurality of structured films 730, which may be discontinuously positioned on the cover (not shown). Preferably, the plurality of structured films 730 may be arranged into a ring shape to surround the light source. Each of the structured films 730 has a plurality of discontinuous micro structures 732 or a plurality of continuous micro structures. In the exemplary embodiment, each of the structured film 730 has a plurality of discontinuous micro structures 732.

Figure 10:
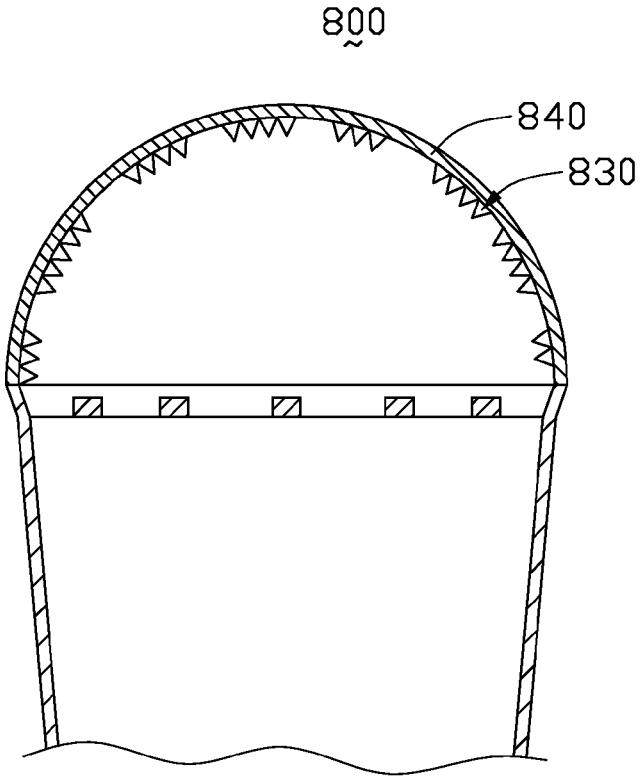
FIG. 10 is a partial cross-sectional view of a lamp in accordance with an exemplary embodiment of the present disclosure.

FIG. 10 is a partial cross-sectional view of a lamp in accordance with an exemplary embodiment of the present disclosure. Referring to FIG. 10, the lamp 800 comprises a plurality of structured films 830, which may be randomly positioned on the cover 840. In addition, the structured films may be randomly positioned in the cover or on the plane of the base.

Figure 11:
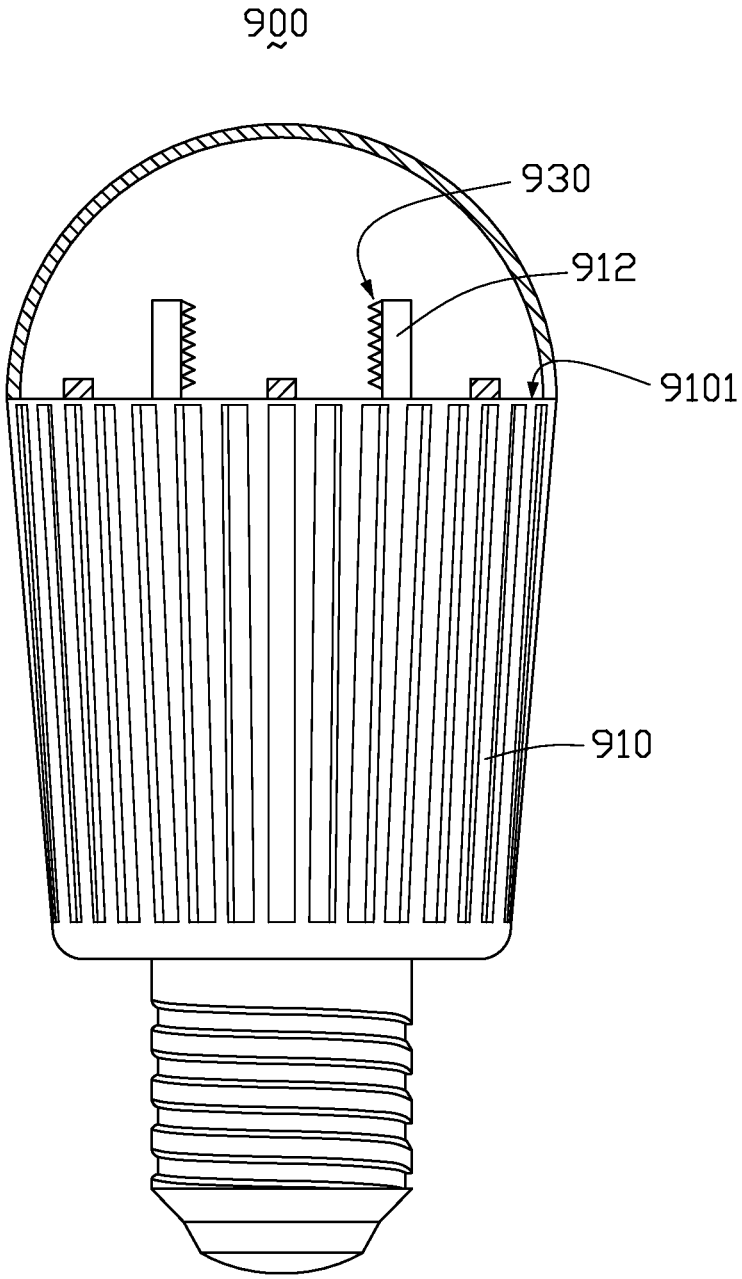
FIG. 11 is a side view of a lamp in accordance with an exemplary embodiment of the present disclosure.

FIG. 11 is a side view of a lamp in accordance with an exemplary embodiment of the present disclosure. Referring to FIG. 11, the base 910 of the lamp 900 may further comprises two transparent bodies 912 on the plane 9101 of the base 910, wherein each of the transparent bodies 912 is assembled with a structured film 930.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broad general meaning of the terms in which the appended claims are expressed.

What is claimed is:

1. A lamp, comprising:

a base having a plane;

at least one light source arranged on the plane and light is substantially forward emitted and side emitted from the light source; and at least one structured film arranged adjacent to the light source, and guiding part of the light backward;

wherein the at least one structured film comprises a plurality of discontinuously positioned micro structures and a plane area positioned between and directly interconnecting two adjacent micro structures, the micro structures being transparent, and the plane area being non-transparent.

2. The lamp of claim 1, wherein the light source comprises an LED (Light Emitting Diode).

3. The lamp of claim 1, further comprising a cover positioned on the base, and covering the light source.

4. The lamp of claim 3, wherein the at least one structured film is also positioned on the cover.

5. The lamp of claim 1, wherein the at least one structured film is a ring shape.

6. The lamp of claim 4, wherein the at least one structured film comprises a plurality of structured films which are discontinuously positioned.

7. The lamp of claim 3, wherein the at least one structured film is positioned in the cover.

8. The lamp of claim 7, wherein the at least one structure film comprises a plurality of structured films which are discontinuously positioned.

9. The lamp of claim 1, further comprising a transparent body assembled with the at least one structured film.

10. The lamp of claim 6, wherein every two adjacent structured films are totally spaced from each other with a void therebetween.

11. A lamp, comprising:

a base having a plane;

at least one LED (Light Emitting Diode) arranged on the plane and light is substantially forward emitted and side emitted from the LED;

a cover positioned on the base, and covering the LED; and at least one structured film positioned on the cover, and arranged adjacent to the LED, and guiding part of the light backward;

wherein the at least one structured film comprises a plurality of discontinuously positioned micro structures and a plane area positioned between and directly interconnecting two adjacent micro structures, the micro structures being transparent, and the plane area being non-transparent.

* * * * *